US011930840B2

(12) United States Patent
Lee et al.

(10) Patent No.: US 11,930,840 B2
(45) Date of Patent: Mar. 19, 2024

(54) AEROSOL GENERATING DEVICE AND AEROSOL GENERATING ARTICLE

(71) Applicant: KT&G CORPORATION, Daejeon (KR)

(72) Inventors: Seung Won Lee, Gwangmyeong-si (KR); Sung Wook Yoon, Suwon-si (KR); Dae Nam Han, Seoul (KR); Yong Hwan Kim, Anyang-si (KR)

(73) Assignee: KT&G CORPORATION, Daejeon (KR)

( * ) Notice: Subject to any disclaimer, the term of this patent is extended or adjusted under 35 U.S.C. 154(b) by 820 days.

(21) Appl. No.: 16/979,219

(22) PCT Filed: Jun. 11, 2020

(86) PCT No.: PCT/KR2020/007572
§ 371 (c)(1),
(2) Date: Sep. 9, 2020

(87) PCT Pub. No.: WO2020/256341
PCT Pub. Date: Dec. 24, 2020

(65) Prior Publication Data

US 2022/0330606 A1 Oct. 20, 2022

(30) Foreign Application Priority Data

Jun. 17, 2019 (KR) ..... 10-2019-0071784
Apr. 8, 2020 (KR) ..... 10-2020-0042973

(51) Int. Cl.
*A24D 1/02* (2006.01)
*A24B 15/167* (2020.01)
(Continued)

(52) U.S. Cl.
CPC ..... *A24D 1/20* (2020.01); *A24B 15/167* (2016.11); *A24D 1/002* (2013.01); *A24D 1/02* (2013.01);
(Continued)

(58) Field of Classification Search
CPC . A24D 1/20; A24D 1/002; A24D 1/02; A24D 1/042; A24B 15/167; A24F 40/65; A24F 40/20; A24F 40/57; A24F 40/51
See application file for complete search history.

(56) References Cited

U.S. PATENT DOCUMENTS 7,726,320 B2 * 6/2010 Robinson ..... A24F 40/40 131/194
9,099,874 B2 8/2015 Yoshikawa
(Continued)

FOREIGN PATENT DOCUMENTS

CA 2 937 976 A1 8/2015
CA 2 940 693 A1 9/2015
(Continued)

OTHER PUBLICATIONS

Canadian Office Action dated Feb. 22, 2023 in Canadian Application No. 3,093,152.
(Continued)

*Primary Examiner* — Tho D Ta
(74) *Attorney, Agent, or Firm* — Sughrue Mion, PLLC

(57) ABSTRACT

An aerosol generating article includes an aerosol generator including a first aerosol generating material which does not include nicotine; a tobacco filler arranged adjacent to an end of the aerosol generator and including a second aerosol generating material including nicotine; a cooler arranged adjacent to an end of the tobacco filler and configured to cool aerosol; and a mouth piece arranged adjacent to an end of the cooler.

14 Claims, 14 Drawing Sheets

(51) Int. Cl.

| | |
|---|---|
| ***A24D 1/00*** | (2020.01) |
| ***A24D 1/04*** | (2006.01) |
| ***A24D 1/20*** | (2020.01) |
| ***A24F 40/20*** | (2020.01) |
| ***A24F 40/51*** | (2020.01) |
| ***A24F 40/57*** | (2020.01) |
| ***A24F 40/65*** | (2020.01) |

(52) U.S. Cl.
CPC ..... *A24D 1/042* (2013.01); *A24F 40/20* (2020.01); *A24F 40/51* (2020.01); *A24F 40/57* (2020.01); *A24F 40/65* (2020.01)

(56) References Cited

U.S. PATENT DOCUMENTS

| | | | | |
|---|---|---|---|---|
| 10,517,329 | B2 | 12/2019 | Batista | |
| 10,687,553 | B2 | 6/2020 | Kaufman et al. | |
| 10,729,185 | B2 | 8/2020 | Henry, Jr. et al. | |
| 11,096,415 | B2 | 8/2021 | Thorens | |
| 2010/0186757 | A1 | 7/2010 | Crooks et al. | |
| 2014/0261486 | A1 | 9/2014 | Potter et al. | |
| 2015/0097513 | A1 | 4/2015 | Liberti et al. | |
| 2015/0098906 | A1 | 4/2015 | Farrow | |
| 2016/0338402 | A1 | 11/2016 | Buehler et al. | |
| 2017/0265525 | A1 | 9/2017 | Li et al. | |
| 2018/0027883 | A1 | 2/2018 | Zuber | |
| 2018/0213843 | A1 | 8/2018 | Mironov | |
| 2018/0235285 | A1* | 8/2018 | Robinson | A24B 15/12 |
| 2018/0335280 | A1 | 11/2018 | Flick | |
| 2019/0008210 | A1 | 1/2019 | Mironov et al. | |
| 2019/0059448 | A1 | 2/2019 | Talon | |
| 2019/0124973 | A1 | 5/2019 | Nakano et al. | |
| 2019/0124995 | A1 | 5/2019 | Henry, Jr. et al. | |
| 2019/0217028 | A1 | 7/2019 | Nakano | |
| 2020/0093185 | A1 | 3/2020 | Lim | |
| 2020/0205467 | A1 | 7/2020 | Liu et al. | |

FOREIGN PATENT DOCUMENTS

| | | | | | |
|---|---|---|---|---|---|
| CN | 105163611 | A | | 12/2015 | |
| CN | 105901773 | A | | 8/2016 | |
| CN | 107087811 | A | | 8/2017 | |
| CN | 107624040 | A | | 1/2018 | |
| CN | 108471806 | A | | 8/2018 | |
| CN | 109068741 | A | * | 12/2018 | A24B 15/167 |
| CN | 109152426 | A | | 1/2019 | |
| CN | 109152427 | A | * | 1/2019 | A24B 15/167 |
| CN | 109788804 | A | | 5/2019 | |
| JP | 2010-506594 | A | | 3/2010 | |
| JP | 2011-205863 | A | | 10/2011 | |
| JP | 2015-503916 | A | | 2/2015 | |
| JP | 2016-537016 | A | | 12/2016 | |
| JP | 2017-511123 | A | | 4/2017 | |
| KR | 10-2013-0130763 | A | | 12/2013 | |
| KR | 10-2016-0124853 | A | | 10/2016 | |
| KR | 10-2019-0011724 | A | | 2/2019 | |
| KR | 10-2019-0021424 | A | | 3/2019 | |
| KR | 10-2019-0027650 | A | | 3/2019 | |
| RU | 89 927 | U1 | | 12/2009 | |
| WO | 2011/010955 | A1 | | 1/2011 | |
| WO | 2014159250 | A1 | | 10/2014 | |
| WO | 2017/207585 | A1 | | 12/2017 | |
| WO | WO-2017207585 | A1 | * | 12/2017 | A24B 15/165 |
| WO | 2018/068438 | A1 | | 4/2018 | |
| WO | 2018/216961 | A1 | | 11/2018 | |
| WO | 2019/105750 | A1 | | 6/2019 | |
| WO | WO-2019105750 | A1 | * | 6/2019 | A24C 5/47 |
| WO | 2020141314 | A1 | | 7/2020 | |
| WO | 2021025363 | A2 | | 2/2021 | |

OTHER PUBLICATIONS

Communication dated Aug. 18, 2021 by the European Patent Office in application No. 20763977.4.
Communication dated Jun. 21, 2021 by the Taiwanese Patent Office in application No. 109120281.
Office Action dated Jan. 21, 2022 from the Korean Intellectual Property Office in KR Application No. 10-2020-0042973.
International Search Report dated Sep. 17, 2020 by the International Searching Authority in application No. PCT/KR2020/007572.
Office Action dated Apr. 18, 2022 issued by the Chinese Patent Office in Chinese Application No. 202080001733.0.
Office Action dated Apr. 18, 2022 issued by the Russian Patent Office in Russian Application No. 2020128206/03.
Communication dated Nov. 15, 2022, issued in Korean Application No. 10-2020-0042973.
Communication dated Oct. 11, 2022, issued in Chinese Application No. 202080001733.0.
Office Action dated Nov. 9, 2021 in Japanese Application No. 2020-552701.
Office Action dated Jan. 6, 2022 in Taiwanese Application No. 109120281.
Korean Office Action dated Jul. 7, 2023 in Application No. 10-2023-0019644.
Korean Office Action dated Oct. 4, 2023 in Korean Application No. 10-2023-0019644.

* cited by examiner

[Fig. 1A]
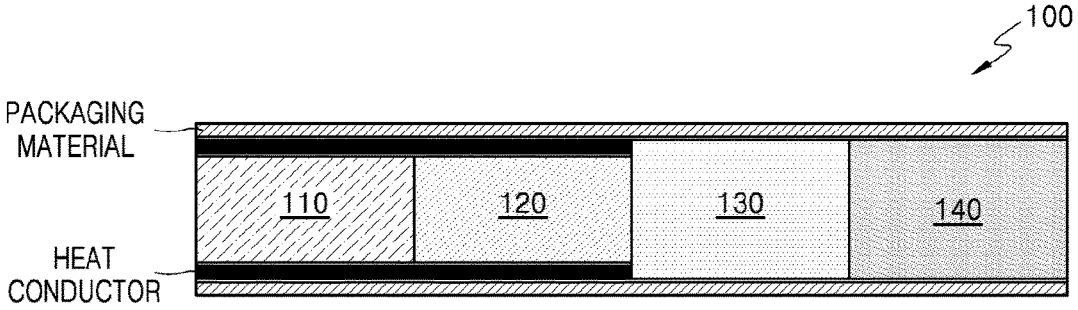
[Fig. 1B]
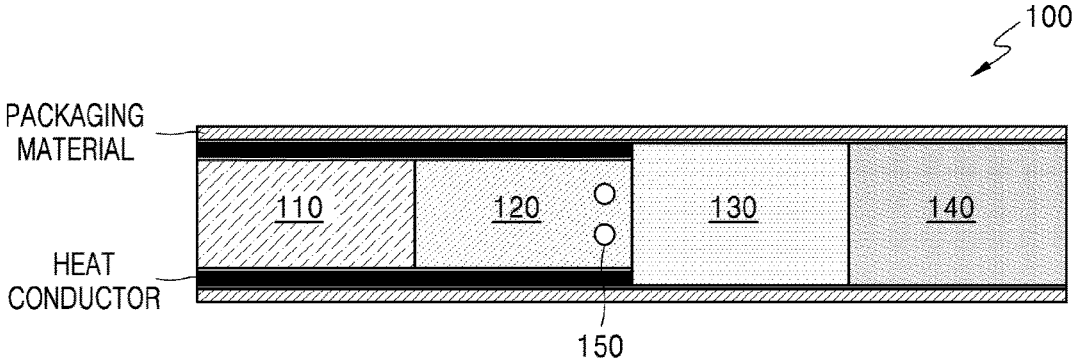
[Fig. 1C]
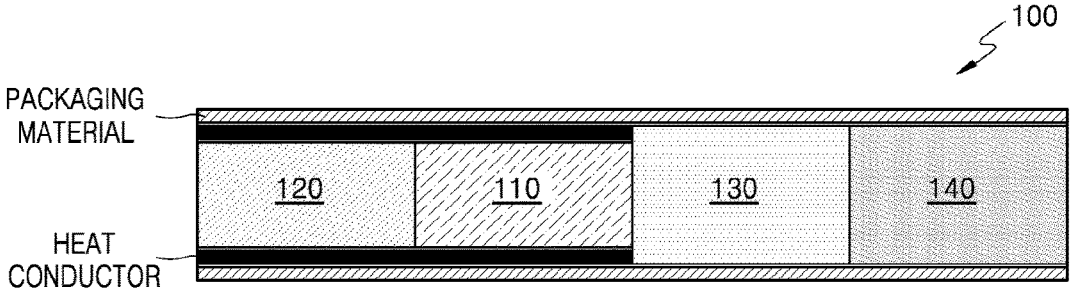
[Fig. 2A]
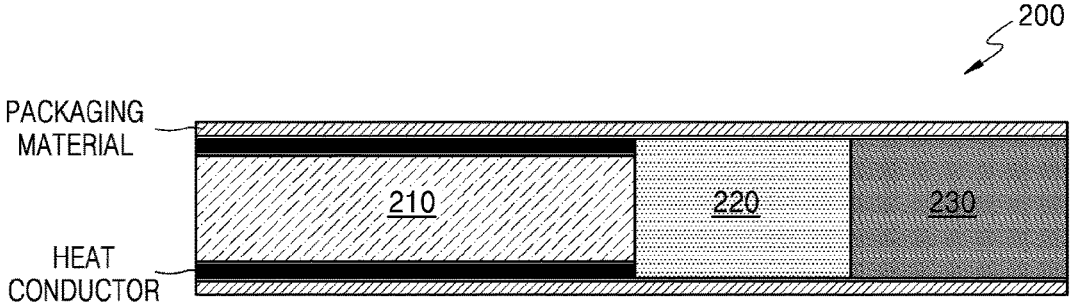
[Fig. 2B]
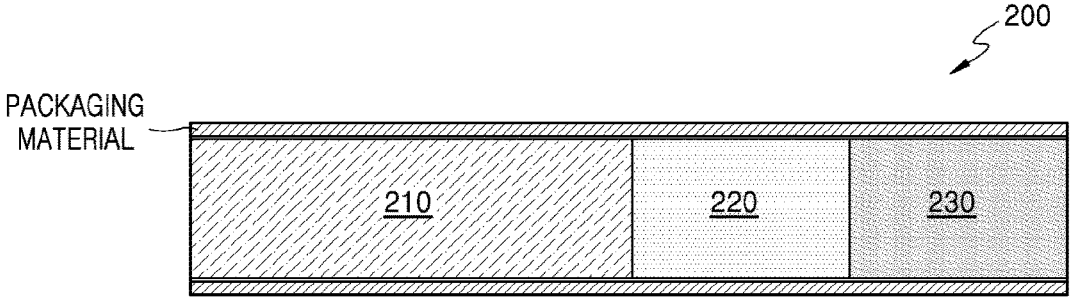

[Fig. 2C]
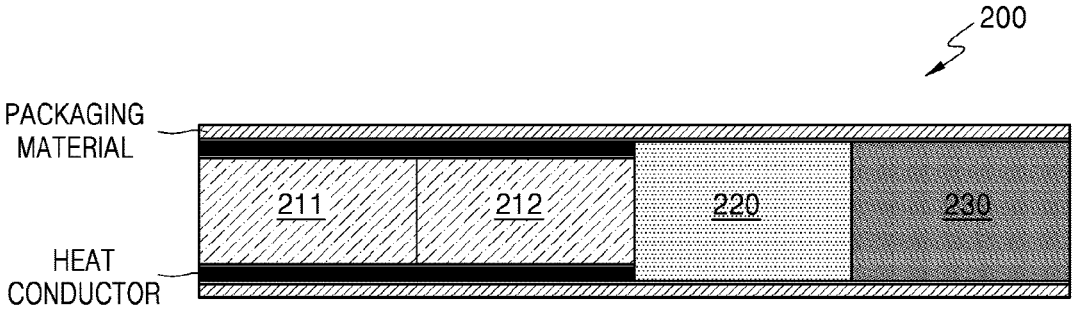
[Fig. 2D]
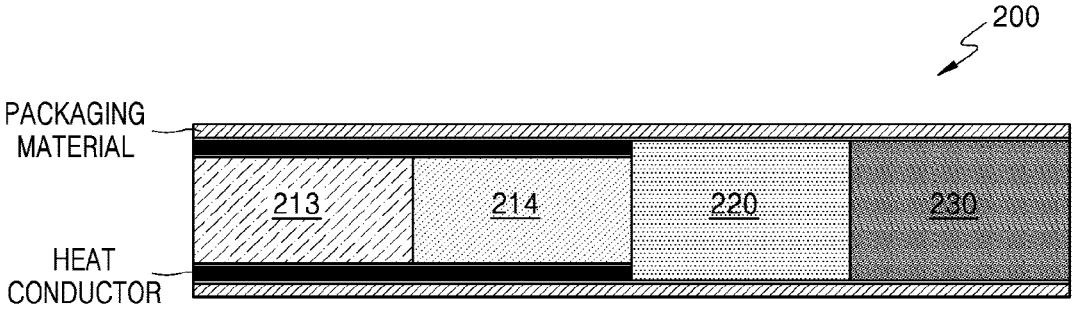
[Fig. 2E]
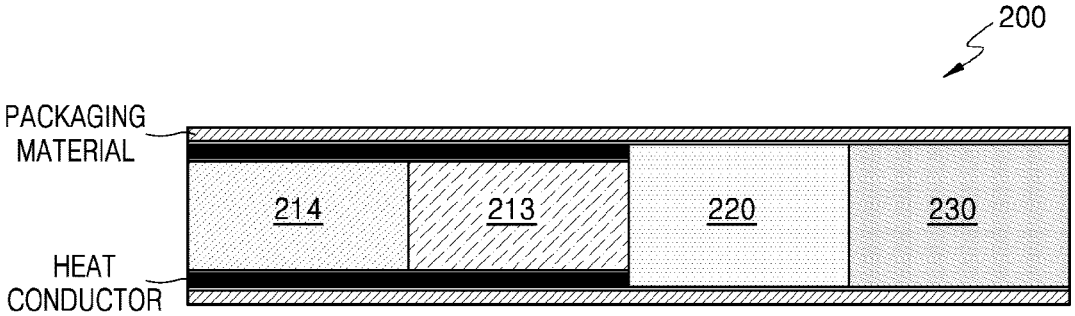
[Fig. 2F]
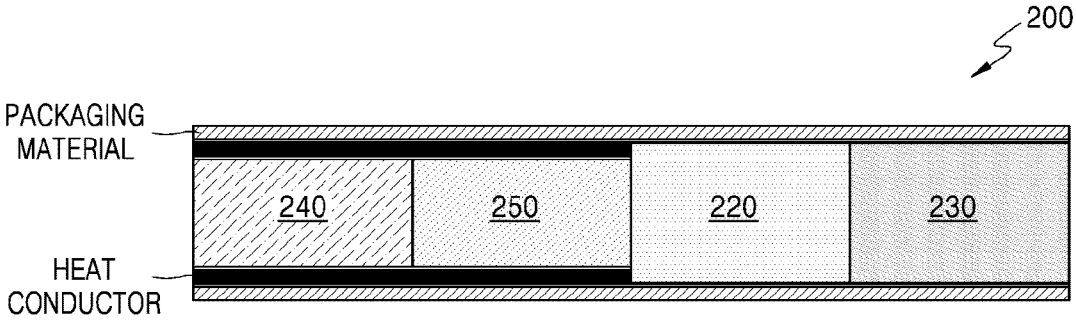
[Fig. 2G]
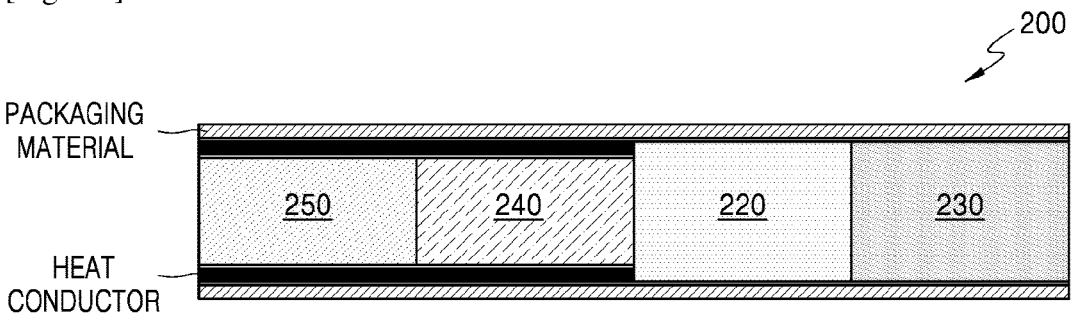

[Fig. 3A]
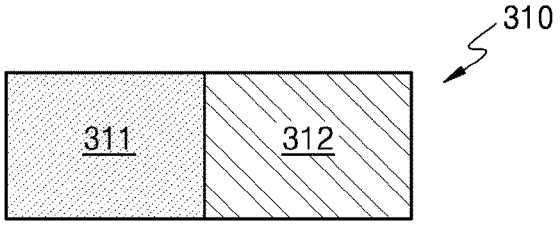
[Fig. 3B]
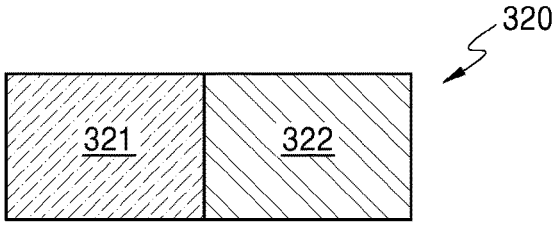
[Fig. 3C]
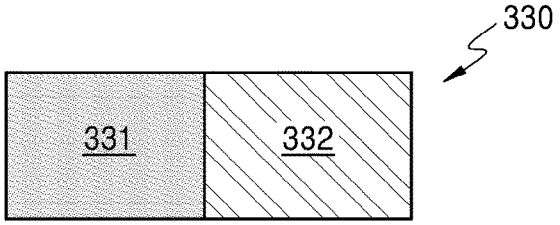
[Fig. 3D]
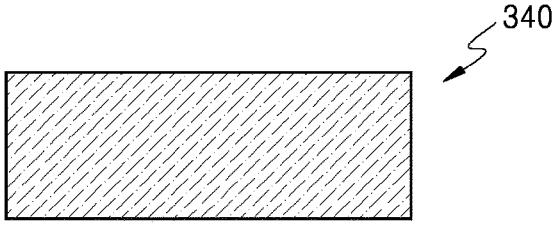
[Fig. 4A]
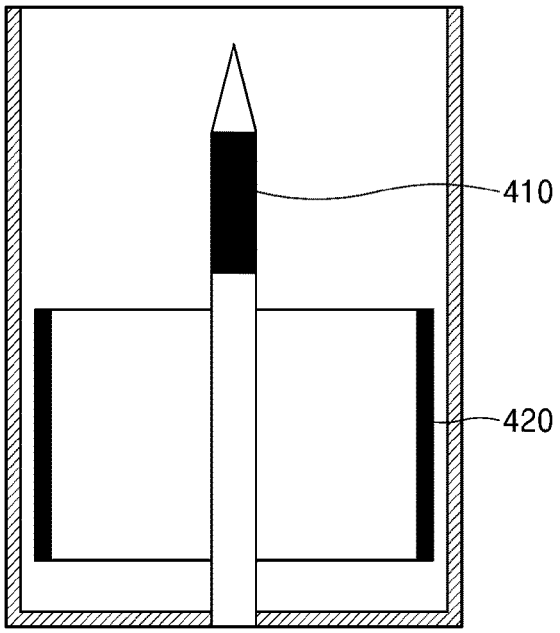

[Fig. 4B]
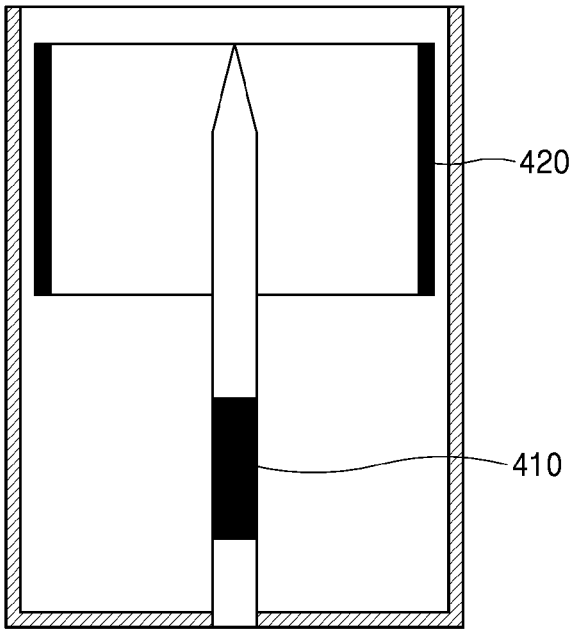
[Fig. 4C]
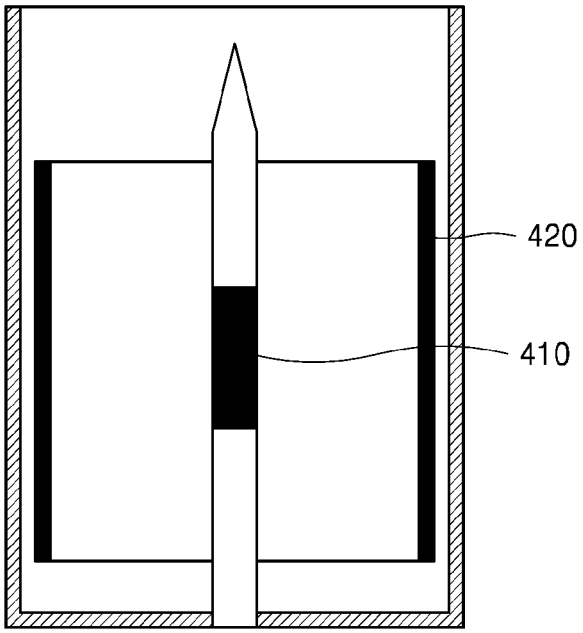

[Fig. 4D]
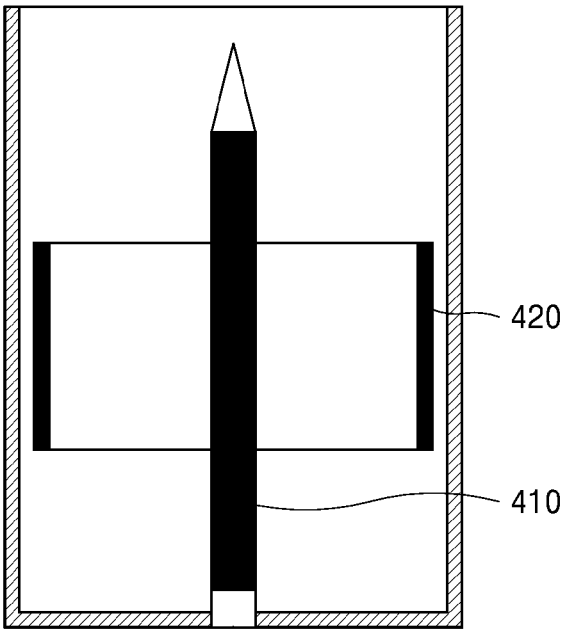
[Fig. 4E]
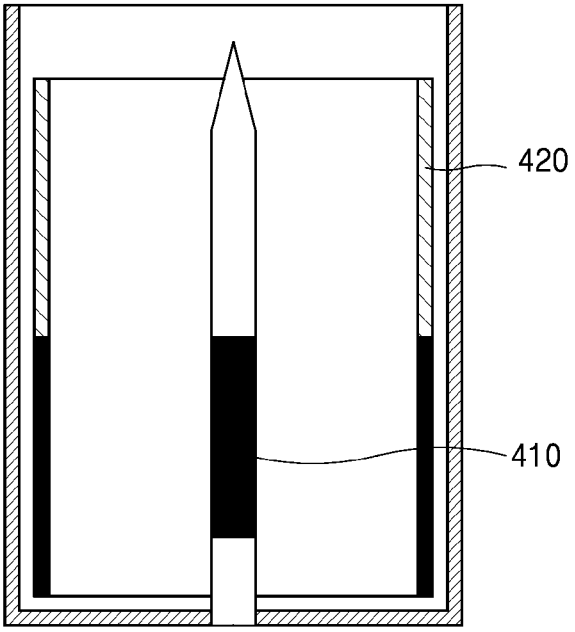

[Fig. 4F]
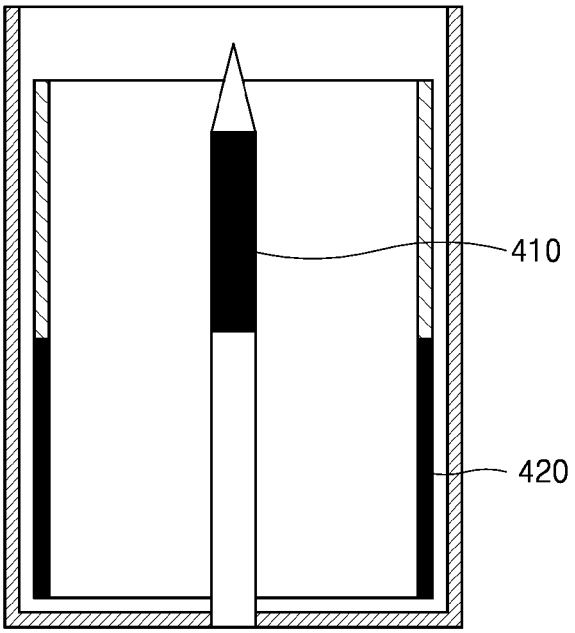
[Fig. 4G]
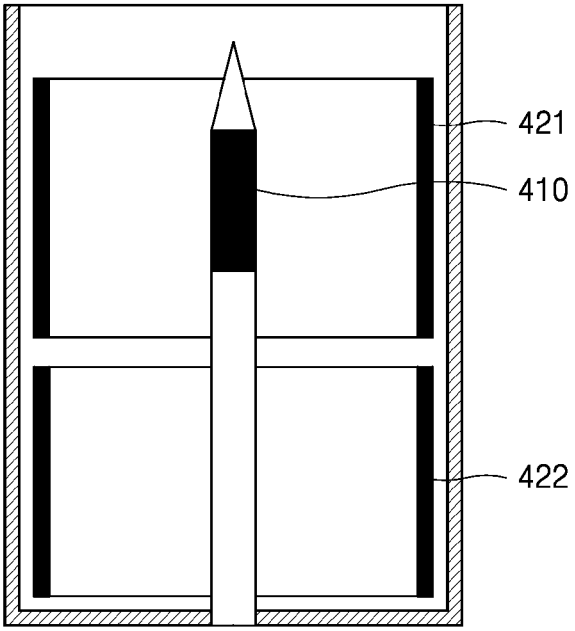

[Fig. 4H]
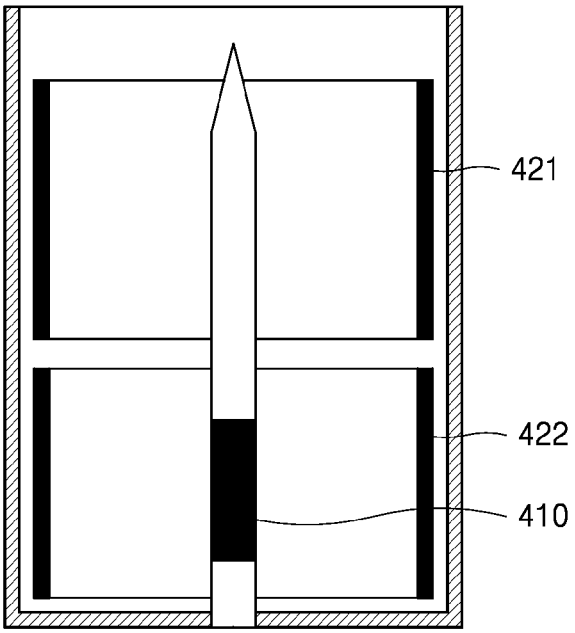
[Fig. 4I]
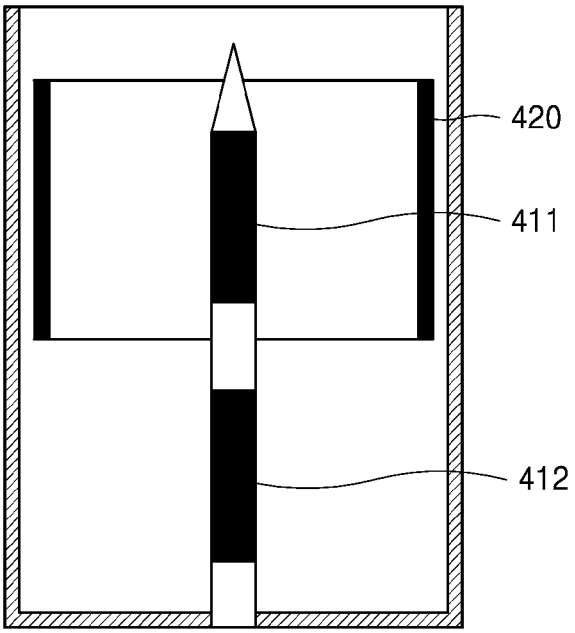

[Fig. 4J]
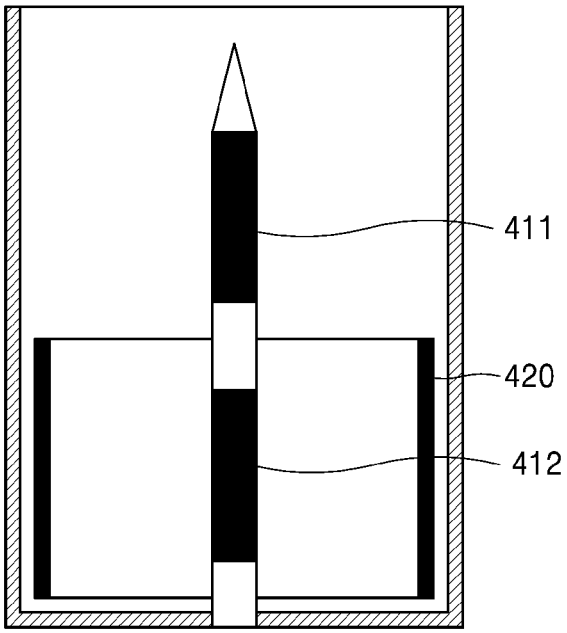
[Fig. 4K]
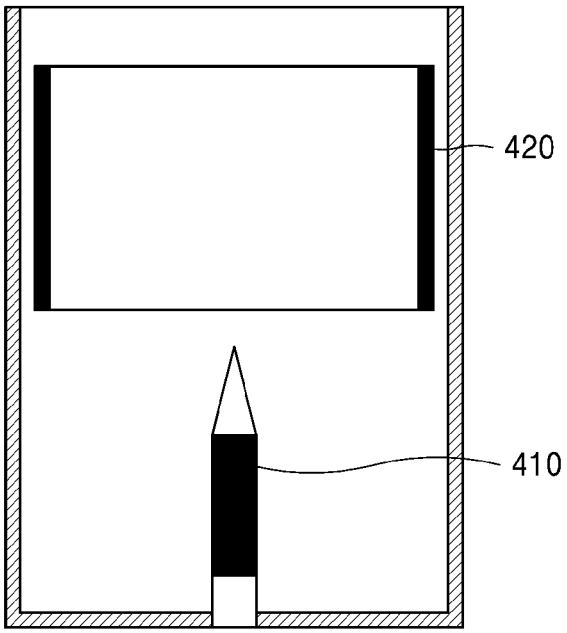

[Fig. 4L]
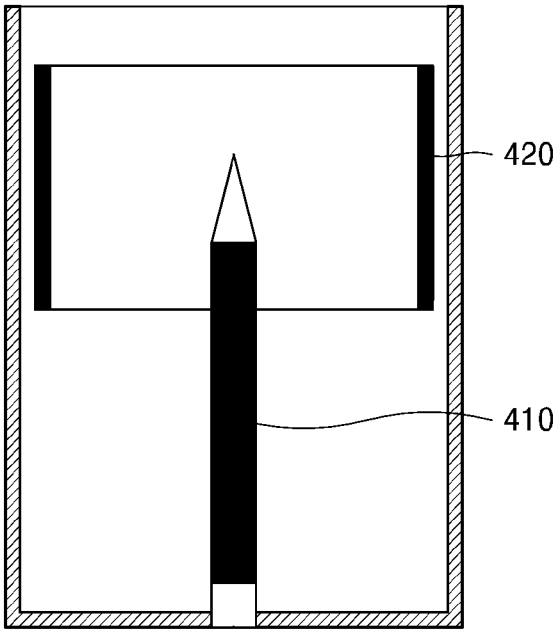
[Fig. 4M]
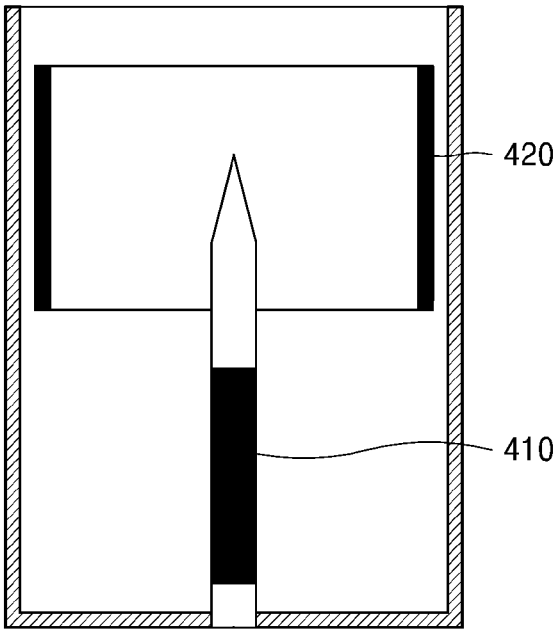

[Fig. 4N]
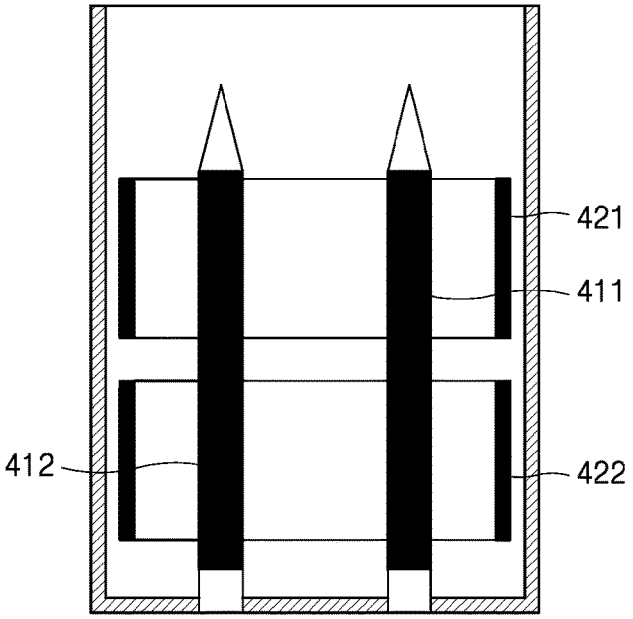
[Fig. 5A]
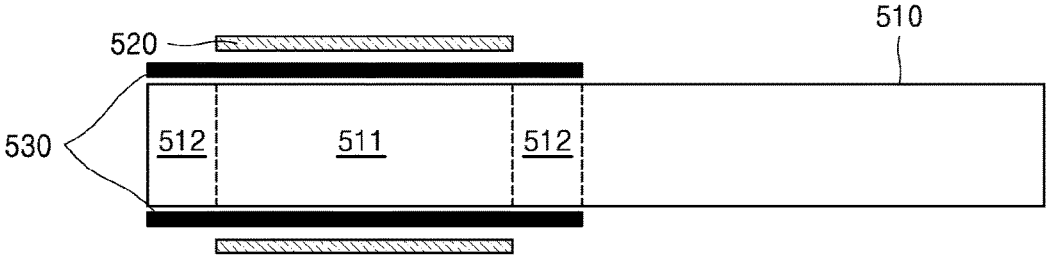
[Fig. 5B]
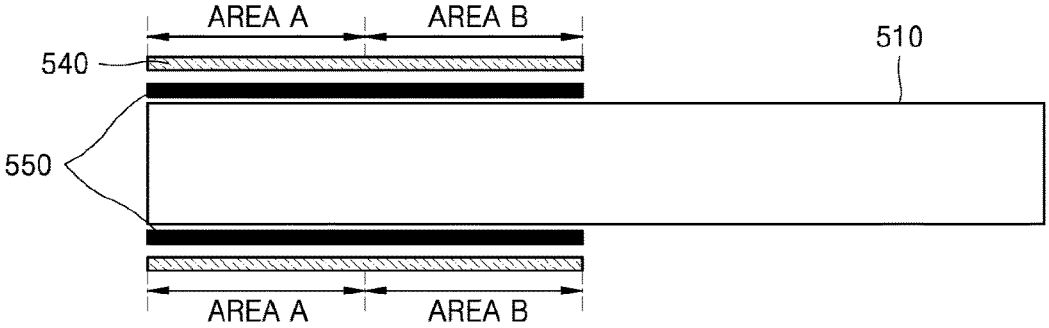
[Fig. 5C]
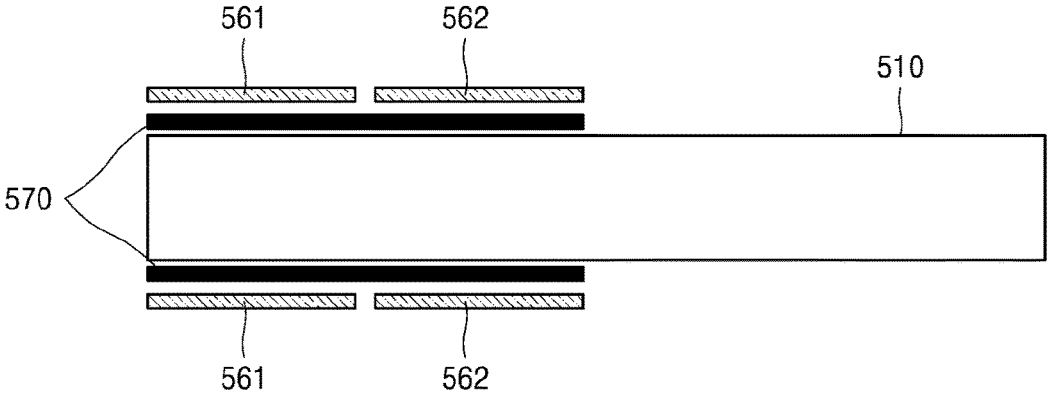

[Fig. 6]
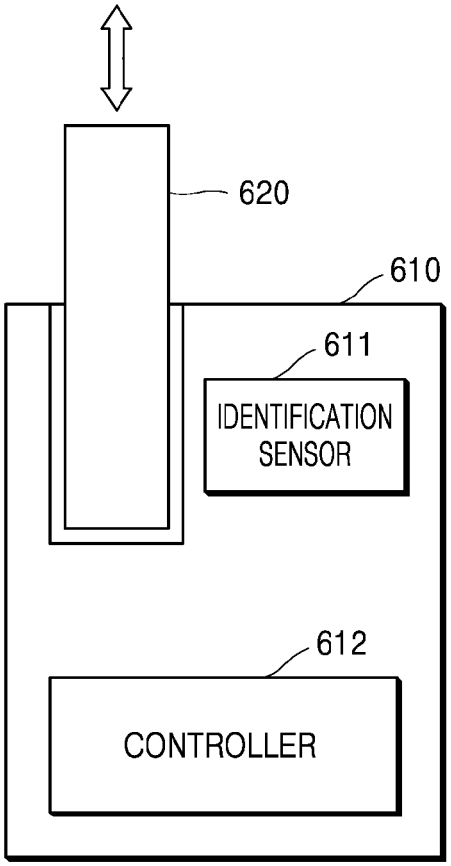
[Fig. 7A]
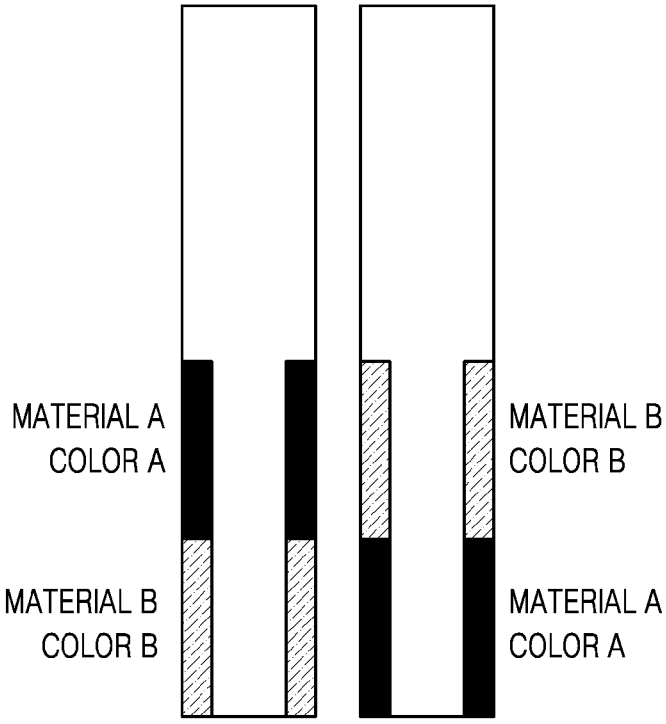

[Fig. 7B]
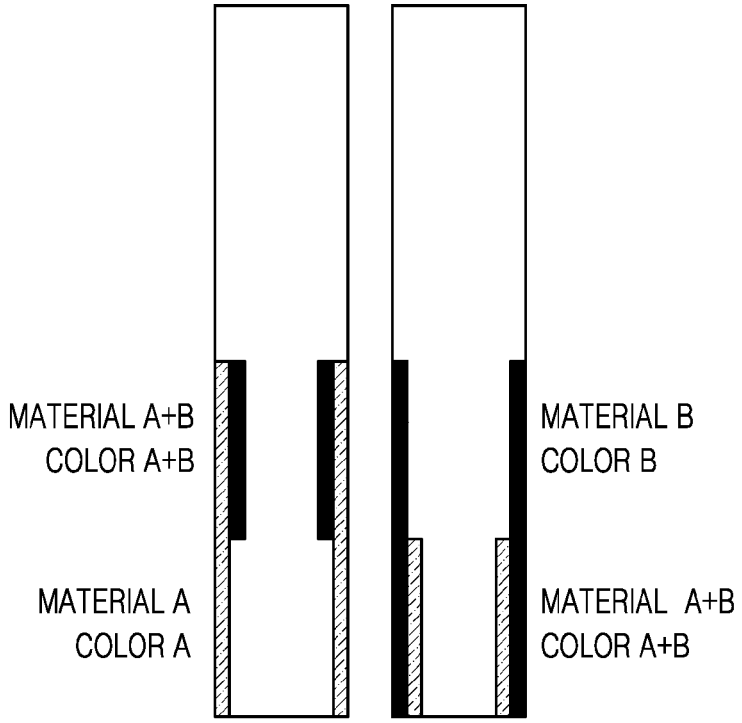
[Fig. 7C]
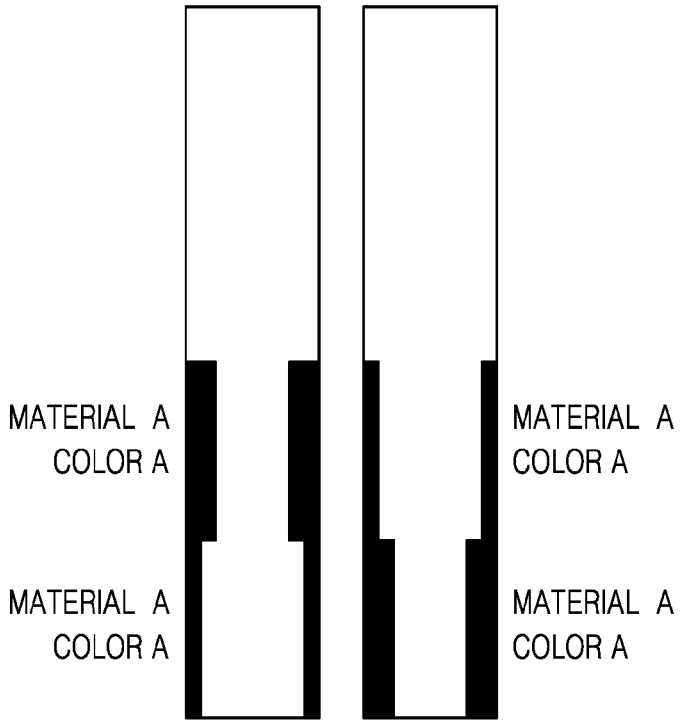

[Fig. 8]
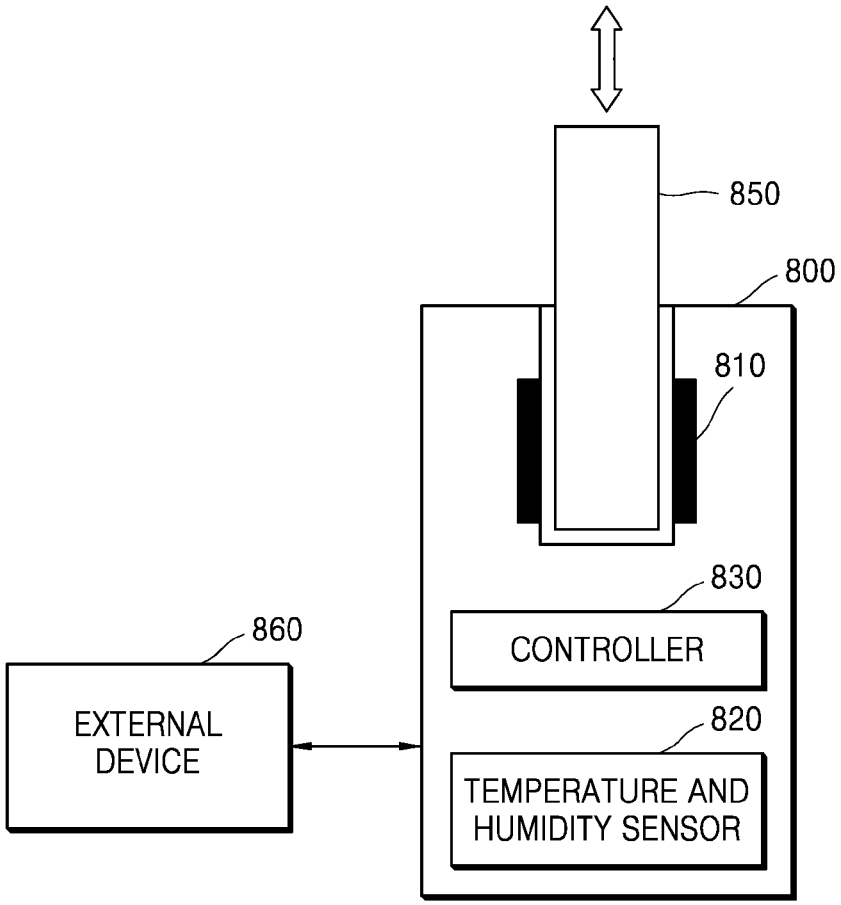

[Fig. 9]
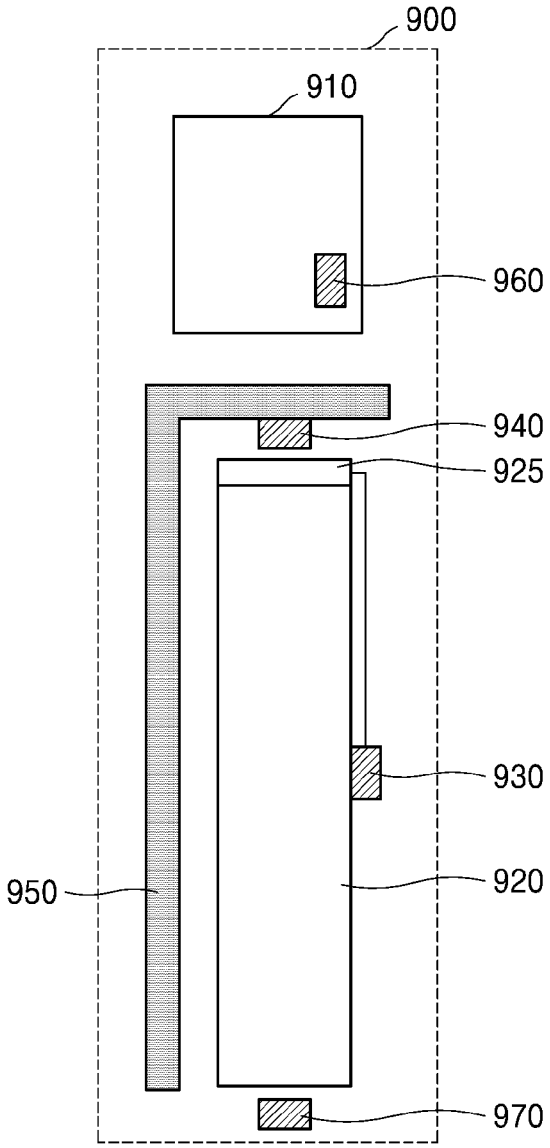
[Fig. 10]
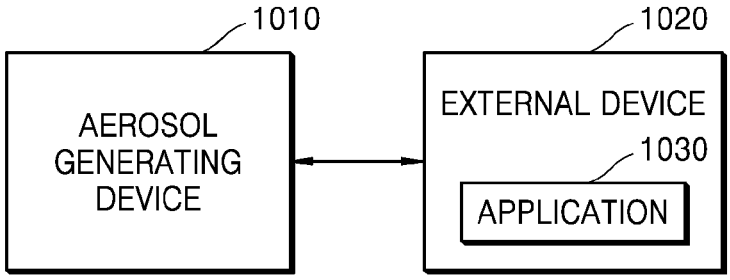

AEROSOL GENERATING DEVICE AND AEROSOL GENERATING ARTICLE

CROSS REFERENCE TO RELATED APPLICATIONS

This application is a National Stage of International Application No. PCT/KR2020/007572 filed Jun. 11, 2020, claiming priorities based on Korean Patent Application No. 10-2019-0071784 filed Jun. 17, 2019 and Korean Patent Application No. 10-2020-0042973 filed Apr. 8, 2020.

DESCRIPTION

Technical Field

One or more embodiments relate to an aerosol generating device and an aerosol generating article.

Background Art

Recently, the demand for alternatives for traditional cigarettes has increased. For example, there is growing demand for an aerosol generating device which produces vapor by heating an aerosol generating material in cigarettes, rather than by combusting cigarettes. Accordingly, studies on a heating-type cigarette and a heating-type aerosol generating device have been actively conducted.

DISCLOSURE OF INVENTION

Solution to Problem

One or more embodiments include an aerosol generating article and an aerosol generating device for generating an aerosol by heating the aerosol generating article.

According to one or more embodiments, an aerosol generating article includes: an aerosol generator including a first aerosol generating material which does not include nicotine; a tobacco filler arranged adjacent to an end of the aerosol generator and including a second aerosol generating material including nicotine; a cooler arranged adjacent to an end of the tobacco filler and configured to cool an aerosol; and a mouthpiece arranged adjacent to an end of the cooler.

Advantageous Effects of Invention

An aerosol generating device and an aerosol generating article according to one or more embodiments provide a user with satisfactory smoking experience.

BRIEF DESCRIPTION OF DRAWINGS

FIGS. 1A through 1C are views illustrating examples of an aerosol generating article.

FIGS. 2A through 2G are views illustrating other examples of an aerosol generating article.

FIGS. 3A through 3D are views illustrating examples of a cooler of an aerosol generating article.

FIGS. 4A through 4N are views illustrating examples of a heating unit of an aerosol generating device.

FIGS. 5A through 5C are views illustrating examples of a coupling relationship between an aerosol generating device and an aerosol generating article.

FIG. 6 is a view illustrating an example of an aerosol generating device.

FIGS. 7A through 7C are views illustrating examples in which an element for identification is included in an aerosol generating article.

FIG. 8 is a block diagram illustrating other examples of an aerosol generating device.

FIG. 9 is a block diagram illustrating another example of an aerosol generating device.

FIG. 10 is a block diagram illustrating an example in which an aerosol generating device and an external device are connected to each other.

BEST MODE FOR CARRYING OUT THE INVENTION

According to one or more embodiments, an aerosol generating article includes: an aerosol generator including a first aerosol generating material which does not include nicotine; a tobacco filler arranged adjacent to an end of the aerosol generator and including a second aerosol generating material including nicotine; a cooler arranged adjacent to an end of the tobacco filler and configured to cool aerosol; and a mouthpiece arranged adjacent to an end of the cooler.

According to one or more embodiments, an aerosol generating device includes: a heater heating an aerosol generating article; a first sensor detecting whether or not the aerosol generating article is inserted; and a controller controlling operation of the heater based on a sensing result from the first sensor.

According to one or more embodiments, an aerosol generating system includes: an aerosol generating device including a space into which an aerosol generating article is inserted, and heating the inserted aerosol generating article; and an external device controlling at least one function of the aerosol generating device by an application installed in the external device a wireless communication network.

Mode for the Invention

With respect to the terms in the various embodiments, the general terms which are currently and widely used are selected in consideration of functions of structural elements in the various embodiments of the present disclosure. However, meanings of the terms may be changed according to intention of one of ordinary skill in the art, a judicial precedence, the appearance of a new technology, and the like. In addition, in certain cases, a term which is not commonly used may be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Hereinafter, the present disclosure will now be described more fully with reference to the accompanying drawings, in which example embodiments of the present disclosure are shown such that one of ordinary skill in the art may easily work the present disclosure. The disclosure may, however, be embodied in many different forms and should not be construed as being limited to the embodiments set forth herein.

It will be understood that, although the terms "first", "second", etc. may be used herein to describe various elements and/or components, these elements and/or components should not be limited by these terms. These terms are only used to distinguish one element or component from other elements or components.

One or more embodiments include an aerosol generating device and an aerosol generating article (e.g., a cigarette) that may be coupled to the aerosol generating device. According to one or more embodiments, an aerosol generating article includes at least one of an aerosol generator, a tobacco filler, a cooler, and a filter unit (e.g., a mouthpiece or a mouthpiece unit). For example, the filter unit may be an acetate filter, and the cooler and the filter unit may include capsules and flavorings.

For example, an aerosol generator may include nicotine.

Materials, orders, and lengths of the aerosol generator and a tobacco filler are not limited to particular examples, and materials and lengths of a cooler and a filter unit are also not limited to particular examples.

An aerosol generating device may generate aerosol with nicotine by heating the aerosol generator and the tobacco filler, and the aerosol is discharged through the cooler and the filter unit to the outside.

For example, the aerosol generating device may generate aerosol by heating at least one of the aerosol generator and the tobacco filler of the aerosol generating article. Alternatively, the aerosol generating device may heat selectively or collectively the inside or the outside of the aerosol generating article.

A sheet formed of a heat conducting material may be arranged outside the aerosol generator and the tobacco filler of the aerosol generating article, and cigarette paper which fixes segments of the aerosol generating article may be arranged on an outer side of the sheet. Here, the aerosol generating device may generate aerosol by uniformly heating the outside of the sheet formed of the heat conducting material.

The aerosol generating device may automatically identify different aerosol generating articles and automatically select a best temperature profile for each of the aerosol generating articles according to the identification result.

Also, the aerosol generating device may recognize an external environment and may include a sensor installed therein for recognizing the external environment or may receive, through communication with an external device, weather information about an area where a user is located. The aerosol generating device may recognize the external environment and automatically select the best temperature profile according to the external environment, thereby providing a user with the abundant amount of smoke and best tastes.

Hereinafter, the present disclosure will now be described more fully with reference to the accompanying drawings, in which example embodiments of the present disclosure are shown such that one of ordinary skill in the art may easily work the present disclosure. The disclosure may, however, be embodied in many different forms and should not be construed as being limited to the embodiments set forth herein.

Also, even if omitted below, the above description may be applied to both an aerosol generating device and an aerosol generating article according to one or more embodiments.

FIGS. 1A through 1C are views illustrating examples of an aerosol generating article.

Referring to FIGS. 1A through 1C, an aerosol generating article 100 includes an aerosol generator 110, a tobacco filler 120, a cooler 130, and a mouthpiece 140. For example, the mouthpiece 140 may be a filter formed of cellulose acetate, and the cooler 130 and the mouthpiece 140 may include capsules and flavorings. Materials, orders, and lengths of the aerosol generator 110 and the tobacco filler 120 are not limited to particular examples, and materials and lengths of the cooler 130 and the mouthpiece 140 are also not limited to particular examples. Also, depending on a heating method of the aerosol generating article 100, the aerosol generating article 100 may or may not include a heat conductor.

An outside of the aerosol generating article 100 may be surrounded by a packaging material (i.e., wrapper). Also, as shown in FIG. 1, a heat conductor may be partially or entirely arranged between the packaging material and the aerosol generator 110 and the tobacco filler 120.

The aerosol generator 110 may not include nicotine. Also, the aerosol generator 110 may include an aerosol generating material from which nicotine is removed. For example, the aerosol generator 110 may include at least one of glycerin, propylene glycol, ethylene glycol, dipropylene glycol, diethylene glycol, triethylene glycol, tetraethylene glycol, and oleyl alcohol but is not limited thereto. For example, the aerosol generator 110 may include a material in which glycerin and propylene glycol are mixed at a ratio of about 8:2. However, the material is not limited to the mixture ratio described above. Also, the aerosol generator 110 may include other additives such as flavors, a wetting agent, and/or organic acid. In addition, the aerosol generator 110 may include a flavored liquid such as menthol or a moisturizer.

The aerosol generator 110 may include a crimped sheet, and the aerosol generator 110 may include an aerosol generating material which is impregnated into the crimped sheet. Also, the aerosol generator 110 may include the other additives, such as the flavors, the wetting agent, and/or the organic acid, and the flavored liquid which are absorbed into the crimped sheet.

The crimped sheet may be a sheet formed of a polymer material. For example, the polymer material may include at least one of paper, cellulose acetate, lyocell, and polylactic acid. For example, the crimped sheet may be a paper sheet that does not generate a heat odor even when heated at a high temperature but is not limited thereto.

A length of the aerosol generator 110 may be within a range of about 4 mm to about 12 mm but is not limited thereto. For example, the length of the aerosol generator 110 may be about 10 mm but is not limited thereto.

The tobacco filler 120 may include nicotine. Also, the tobacco filler 120 may include an aerosol generating material such as glycerin and propylene glycol. In addition, the tobacco filler 120 may include other additives such as flavors, a wetting agent, and/or organic acid. Moreover, the tobacco filler 120 may include a flavored liquid, such as menthol or a moisturizer, which is injected to the tobacco filler 120.

As an example, the aerosol generating material may include pipe tobacco or a reconstituted tobacco material. In detail, the aerosol generating material may include nicotine which may be acquired by shaping or reconstituting tobacco leaves. As another example, the aerosol generating material may include free base nicotine, nicotine salt, or a combination thereof. In detail, the nicotine may be naturally generated nicotine or synthesized nicotine.

For example, the tobacco filler 120 may include a mixture of different types of tobacco leaves. Also, the mixture may be processed through various types of processing processes but is not limited thereto.

Nicotine salt may be formed by adding appropriate acid, including organic or inorganic acid, to nicotine. Acid for forming the nicotine salt may be appropriately selected in consideration of a blood nicotine absorption rate, a heating temperature of a heater, flavors or tastes, solubility, and the like. For example, the acid for forming the nicotine salt may be a single acid selected from the group consisting of benzoic acid, lactic acid, salicylic acid, lauric acid, sorbic acid, levulic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharinic acid, malonic acid, and malic acid or may be a mixture of two or more acids selected from the group, but is not limited thereto.

The tobacco filler 120 may be manufactured in various forms. For example, the tobacco filler 120 may be formed as a sheet or a strand. Also, the tobacco filler 120 may be formed as pipe tobacco which is formed of tiny bits cut from a tobacco sheet.

A length of the tobacco filler 120 may be within a range of about 6 mm to about 18 mm but is not limited thereto. For example, the length of the tobacco filler 120 may be about 12 mm but is not limited thereto.

The cooler 130 may decrease the temperature of the aerosol so that a user may puff aerosol at an appropriate temperature.

For example, the cooler 130 may be formed of cellulose acetate and may be a tube-type structure having a hollow inside. For example, the cooler 130 may be formed by adding a plasticizer (e.g., triacetin) to a cellulose acetate tow. For example, mono denier of the cooler 130 may be 5.0, and total denier of the cooler 130 may be 28,000 but is not limited thereto.

For example, the cooler 130 may be formed of paper and may be a tube-type structure having a hollow inside. Also, the cooler 130 may have at least one hole through which external air may be introduced.

The cooler 130 may be formed of laminated paper formed of multiple sheets of paper. For example, the cooler 130 may be formed of laminated paper formed of outer paper, intermediate paper, and inner paper, but is not limited thereto. An inner surface of the inner paper constituting the laminated paper may be coated with a preset material (e.g., polylactic acid).

When the cooler 130 is formed of paper, a total thickness of the cooler 130 may be in the range of about 330 μm to about 340 μm. Alternatively, the total thickness of the cooler 130 may be about 333 μm but is not limited thereto.

Also, when the cooler 130 is formed of paper, a total basis weight of the cooler 130 may be in the range of about 230 $g/m^2$ to about 250 $g/m^2$. Alternatively, the total basis weight of the cooler 130 may be about 240 $g/m^2$ but is not limited thereto.

A diameter of the hollow included in the cooler 130 may be an appropriate diameter within a range of about 4 mm to about 8 mm, but is not limited thereto. Alternatively, the diameter of the hollow of the cooler 130 may be an appropriate diameter within a range of about 7.0 mm to about 7.5 mm but is not limited thereto. A length of the cooler 130 may be an appropriate length within a range of about 4 mm to about 30 mm but is not limited thereto. Alternatively, the length of the cooler 130 may be about 12 mm but is not limited thereto.

The cooler 130 is not limited to the example described above and any coolers capable of cooling aerosol may be used.

The mouthpiece 140 may be manufactured by adding a plasticizer (e.g., triacetin) to a cellulose acetate tow. A length of the mouthpiece 140 may be an appropriate length within a range of about 4 mm to about 30 mm but is not limited thereto. Preferably, the length of the mouthpiece 140 may be about 14 mm but is not limited thereto.

The mouthpiece 140 may also be manufactured to generate flavors. As an example, a flavored liquid may be injected onto the mouthpiece 140 or an additional fiber coated with a flavored liquid may be inserted into the mouthpiece 140.

Also, the mouthpiece 140 may include at least one capsule. As an example, the capsule may include a flavored liquid, and flavors may be generated by the flavored liquid leaking when the capsule is crushed. As another example, the capsule may include an aerosol generating material, and aerosol may be generated by the aerosol generating material leaking when the capsule is crushed. The capsule may have a configuration in which a flavored liquid or an aerosol generating material is wrapped with a film. The capsule may have a spherical or cylindrical shape but is not limited thereto.

Referring to FIG. 1B, the tobacco filler 120 may include cooling holes 150. For example, first cooling of aerosol may be performed by perforating the tobacco filler 120, and secondary cooling of the aerosol may be performed as the first-cooled aerosol passes through the cooler 130, Therefore, a cooling effect of the aerosol may be significantly increased. The cooler 130 may not include the cooling holes 150 according to a material thereof.

Referring to FIG. 1C, the aerosol generator 110 may be arranged downstream from the tobacco filler 120. In other words, the aerosol generating article 100 of FIG. 1A and the aerosol generating article 100 of FIG. 1C have a different order in which the aerosol generator 110 and the tobacco filler 120 are arranged.

FIGS. 2A through 2G are views illustrating other examples of an aerosol generating article.

Compared to FIGS. 1A through 1C, FIGS. 2A through 2E illustrate examples in which aerosol generators 210, 211, 212, and 213 include nicotine. Also, FIGS. 2F and 2G illustrate examples in which an aerosol generator 240 and a nicotine-including portion 250 are separate segments.

The aerosol generators 210, 211, 212, and 213 of FIGS. 2A through 2E may be a combination of the aerosol generator 110 and the tobacco filler 120 of FIGS. 1A through 1C. The aerosol generator 240 of FIGS. 2F and 2G is the same as the aerosol generator 110 of FIGS. 1A through 1C.

The outside of an aerosol generating article 200 of FIGS. 2A through 2G may be surrounded by a packaging material (i.e., wrapper). According to embodiments, the aerosol generating article 200 may further include a heat conductor.

The nicotine-including portion 250 may include nicotine acquired by shaping or reconstituting tobacco leaves. Alternatively, the nicotine-including portion 250 may include one of free base nicotine, nicotine salt, and a combination thereof. For example, the nicotine-including portion 250 may include a crimped sheet, and the nicotine-including portion 250 may include nicotine which is impregnated into the crimped sheet. Also, the nicotine-including portion 250 may include other additives, such as flavorings, a wetting agent, and/or organic acid, and a flavored liquid which are absorbed into the crimped sheet.

The crimped sheet may be a sheet formed of a polymer material. For example, the polymer material may include at least one of paper, cellulose acetate, lyocell, and polylactic acid. For example, the crimped sheet may be a paper sheet that does not generate a heat odor even when heated at a high temperature but is not limited thereto.

A cooler 220 and a mouthpiece 230 illustrated in FIGS. 2A through 2G are the same as described above with reference to FIGS. 1A through 1C. Also, depending on a heating method of the aerosol generating article 200, the aerosol generating article 200 may or may not include a heat conductor.

A length extending portion 214 may be formed of cellulose acetate. For example, the length extending portion 214 may be manufactured by adding a plasticizer (e.g., triacetin) to a cellulose acetate tow.

FIGS. 3A through 3D are views illustrating examples of a cooler of an aerosol generating article.

FIGS. 3A through 3D illustrate the coolers 310, 320, 330, and 340.

Referring to FIGS. 3A through 3C, the coolers 310, 320, and 330 may have a configuration in which segments 312, 322, and 332 formed of polylactic acid are coupled to other segments 311, 321, and 331, respectively. Here, the segments 311, 321, and 331 may be formed of cellulose acetate and/or paper. Also, the other segments 311, 321, and 331 may include hollows but are not limited thereto.

Referring to FIG. 3D, the cooler 340 may be formed of paper and may be a tube-type structure having a hollow inside. For example, an inner surface or an outer surface of the cooler 340 may be coated with a preset material (e.g., polylactic acid).

Also, although not illustrated in FIGS. 1A through 3D, the aerosol generating articles 100 and 200 may further include a plug disposed at a front end thereof. For example, the plug may be formed of cellulose acetate but are not limited thereto.

FIGS. 4A through 4N are views illustrating examples of a heating unit (i.e., heater) of an aerosol generating device.

Referring to FIGS. 4A through 4N, a heating temperature of inside and/or outside of an aerosol generating article may be selectively (or collectively) adjusted by internal heating heaters 410, 411, and 412 and external heating heaters 420, 421, and 422.

Referring to FIGS. 4I and 4J, a first temperature achieved by a first internal heating heater 411 may be the same as or different from a second temperature achieved by a second internal heating heater 412. According to a type of a medium included in an aerosol generating article, a first temperature and a second temperature may be different from each other.

FIGS. 4K through 4M illustrate examples in which the internal heating heater 410 and the external heating heater 420 are separated such that each portion of the aerosol generating article may be heated to a different temperature.

FIG. 4N illustrates an example in which an aerosol generating device includes a plurality of heating units 411, 412, 421, and 422. FIG. 4N illustrates two internal heating heaters 411 and 412 and two external heating heaters 421 and 422, but the number of heaters is not limited to the example illustrated in FIG. 4N. Also, FIG. 4N illustrates that the internal heating heaters 411 and 412 and the external heating heaters 421 and 422 are entirely heated but are not limited thereto. In other words, the internal heating heaters 410, 411, and 412 or the external heating heaters 420, 421, and 422 illustrated in FIGS. 4A through 4N may be heated entirely or partially.

FIGS. 5A through 5C are views illustrating examples of a coupling relationship between an aerosol generating device and an aerosol generating article.

External heating heaters 520, 540, 561, and 562 illustrated in FIGS. 5A through 5C may be one of the external heating heaters 420, 421, and 422 illustrated in FIGS. 4A through 4N.

Referring to FIG. 5A, at least a portion of an aerosol generating article 510 may be surrounded by a packaging material 530 (hereinafter referred to as a heat conductive wrapper) including a heat conductive material. Here, the heat conductive wrapper 530 may be a heat conductor as illustrated in FIGS. 1A through 2G. The external heating heater 520 may be arranged near at least a portion of the heat conductive wrapper 530. Here, the heat conductive material may be a paramagnetic material (e.g., aluminum, platinum, ruthenium, or the like) that does not function as a susceptor.

As an example, the external heating heater 520 may be an induction heater. When the external heating heater 520 is the induction heater, the heat conductive wrapper 530 of the aerosol generating article 510 may conduct heat generated by the susceptor. This is to maintain a section 511 of the aerosol generating article 510, which is directly heated by the external heating heater 520, in a high temperature state and conduct heat to a section 512 through the heat conductive wrapper 530.

As another example, the external heating heater 520 may be an electro-resistive heater. When the external heating heater 520 is the electro-resistive heater, a length of the section 511 directly heated by the external heating heater 520 may be smaller than a total length of the heat conductive wrapper 530. As such, while the section 511 of the aerosol generating article 510 may maintain a high temperature, the section 512 may maintain a relatively low temperature.

Referring to FIG. 5B, a heat conductive wrapper 550 may surround at least a portion of the aerosol generating article 510. Here, the heat conductive wrapper 550 may be a heat conductor as illustrated in FIGS. 1A through 2G. A heater 540 may be arranged outside or inside the portion of the aerosol generating article 510 surrounded by the heat conductive wrapper 550. For example, the heat conductive wrapper 550 may include a paramagnetic material (e.g., aluminum, platinum, ruthenium, or the like) that does not function as a susceptor.

For example, power densities or heat capacities of area A and area B of the heater 540 may be different from each other. As an example, the heat capacities of the area A and the area B of the heater 540 may be made different by a difference in a pattern, a shape, a density, or the like of a heating electrode (e.g., an electrically conductive track). As another example, when the heater 540 is an induction heater, the heat capacities of the area A and the area B of the heater 540 may be made different by a difference in patterns, shapes, densities, or the like of coils or susceptors of the area A and the area B.

Referring to FIG. 5C, a heat conductive wrapper 570 may surround at least a portion of the aerosol generating article 510. Here, the heat conductive wrapper 570 may be a heat conductor as illustrated in FIGS. 1A through 2G. A plurality of heaters 561 and 562 may be arranged outside or inside the portion of the aerosol generating article 510 surrounded by the heat conductive wrapper 570. For example, the heat conductive wrapper 570 may include a paramagnetic material (e.g., aluminum, platinum, ruthenium, or the like) that does not function as a susceptor.

As an example, the plurality of heaters 561 and 562 may be induction heaters and may be formed of a single coil or a plurality of coils. As another example, the plurality of heaters 561 and 562 may be electro-resistive heaters.

FIG. 6 is a view illustrating an example of an aerosol generating device.

Referring to FIG. 6, an aerosol generating device 610 includes an identification sensor 611 and a controller 612. The aerosol generating device 610 illustrated in FIG. 6 shows elements related to the present embodiment. Therefore, it will be understood by one of ordinary skill in the art related to the present embodiment that the aerosol generating device 610 may further include other elements in addition to the elements illustrated in FIG. 6.

The controller 612 may automatically identify an aerosol generating article 620 inserted into the aerosol generating device 610. Also, the controller 612 may automatically activate the aerosol generating device 610 and/or select a best temperature profile for operating a heater, according to the identification result.

As an example, the identification sensor 611 may be a sensor that generates a magnetic field signal of a constant frequency and reads a frequency signal of a magnetic field that is reflected back from the aerosol generating article 620. As another example, the identification sensor 611 may be a sensor that distinguishes an external color of the aerosol generating article 620 or a shape such as a band formed on the aerosol generating article 620. As another example, the identification sensor 611 may also be configured to detect reflection, refractive index, or transmittance of light. As another example, the identification sensor 611 may be an optical sensor, an infrared sensor, an ultrasonic sensor, or the like.

The controller 612 may control overall operations of the aerosol generating device 610. In detail, the controller 612 controls operations of other elements included in the aerosol generating device 610, as well as operations of the identification sensor 611 and a heater. Also, the controller 612 may determine whether or not the aerosol generating device 610 is in an operable state by checking states of respective elements of the aerosol generating device 610.

The controller 612 may be at least one processor. Here, the processor may be implemented as an array of a plurality of logic gates or may be implemented as a combination of a general-purpose microprocessor and a memory in which a program executable in the microprocessor is stored. Also, one of ordinary skill in the art to which the present embodiment pertains will understand that the processor may be implemented in other forms of hardware.

FIGS. 7A through 7C are views illustrating examples in which an element for identification is included in an aerosol generating article.

Referring to FIGS. 7A through 7C, in each segment of an aerosol generating article, an element for identification may include the same material or different materials. For example, referring to FIG. 7C, an element for identification in each segment of the aerosol generating article may have the same material or the same color but may have a different thickness, area, shape, and the like. Alternatively, referring to FIG. 7A or 7B, an element for identification in each segment of the aerosol generating article may have a different material or color. The arrangement order of the elements for identification is not limited to a particular example.

FIG. 8 is a view illustrating another example of an aerosol generating device.

Referring to FIG. 8, an aerosol generating device 800 includes a heater 810, a temperature and humidity sensor 820, and a controller 830. The aerosol generating device 800 illustrated in FIG. 8 shows elements related to the present embodiment. Therefore, it will be understood by one of ordinary skill in the art related to the present embodiment that the aerosol generating device 800 may further include other elements in addition to the elements illustrated in FIG. 8.

The heater 810 illustrated in FIG. 8 may be at least one of the internal heating heaters 410, 411, and 412 and the external heating heaters 420, 421, and 422 illustrated in FIGS. 4A through 4N.

Referring to FIG. 8, the aerosol generating device 800 may recognize an external environment and select a best temperature profile according to the recognized external environment to operate the heater 810. Therefore, the aerosol generating device 800 may provide a user with vapor that best suits the user's taste.

To adjust quality (e.g., tastes or amount of vapor) of aerosol, the aerosol generating device 800 may operate according to a preset temperature heating condition (i.e., a temperature profile). In general, a temperature profile is uniformly applied in one uniform pattern to prevent a sensory difference in an aerosol from being generated due to variations between aerosol generating devices 800, variations between aerosol generating articles 850, or the like.

Referring to FIG. 8, the temperature and humidity sensor 820 may be arranged inside the aerosol generating device 800 to acquire temperature information or humidity information of a current location where the aerosol generating device 800 is located. Therefore, the aerosol generating device 800 may apply various temperature profiles for heating the aerosol generating article 850. For example, temperature profile A may be optimized for a hot and humid area, temperature profile B may be optimized for a cold and dry area, and temperature profile C may be optimized for an area that exhibits plain temperature and humidity. In this case, the aerosol generating device 800 may recognize an external environment of the aerosol generating device 800 through the temperature and humidity sensor 820 and select the most appropriate temperature profile from the temperature profiles A, B, and C on the basis of the recognition result.

For example, the aerosol generating device 800 may select a temperature profile by using a sensing value of the temperature and humidity sensor 820 or may select a temperature profile by using weather information received from an external device 860.

Also, the aerosol generating device 800 may switch to another temperature profile in consideration of atmospheric pressure, temperature, humidity, and the like of a current location. For example, the aerosol generating device 800 may check location information of a user and accurately recognize weather information of the user's location based on the location information. Therefore, the aerosol generating device 800 may switch to another temperature profile based on the recognized weather information.

For example, the aerosol generating device 800 may select one temperature profile from among a plurality of temperature profiles according to temperature and/or humidity detected by the temperature and humidity sensor 820.

TABLE 1

| Temperature and Humidity Detection Result | Selected Temperature Profile |
|---|---|
| High Temperature *High Humidity | Temperature Profile 1 |
| High Temperature *Normal Humidity | Temperature Profile 2 |
| High Temperature *Low Humidity | Temperature Profile 3 |
| Room Temperature *High Humidity | Temperature Profile 4 |
| Room Temperature *Normal Humidity | Temperature Profile 5 |
| Room Temperature *Low Humidity | Temperature Profile 6 |
| Low Temperature *High Humidity | Temperature Profile 7 |
| Low Temperature *Normal Humidity | Temperature Profile 8 |
| Low Temperature *Low Humidity | Temperature Profile 9 |

Table 1 is a table for explaining a process in which the controller 830 determines a temperature profile for the heater 810. Referring to Table 1, a memory of the aerosol generating device 800 may store criteria for distinguishing high temperature, room temperature, and low temperature and a criterion for distinguishing high humidity, normal humidity, and low humidity. For example, the controller 830 may further subdivide temperature and humidity, and in that embodiment, the number of temperature profiles generated by combinations of temperature and humidity may be more than nine. The controller 830 may check a sensing result from the temperature and humidity sensor 820, and determine which criterion is the closest to external temperature and/or humidity of the aerosol generating device 800. Therefore, the controller 830 may select an appropriate temperature profile from among a plurality of pre-stored temperature profiles. For convenience of description, Table 1 shows that the pre-stored temperature profiles are mapped to combinations of temperature and humidity, but are not limited thereto. In other words, pre-stored temperature profiles may be mapped only to an external temperature or may be mapped only to external humidity.

The controller 830 may finely adjust a preset temperature profile on the basis of temperature and/or humidity detected by the temperature and humidity sensor 820.

TABLE 2

| | Level 1 | Level 2 | Level 3 (default) | Level 4 | Level 5 |
|---|---|---|---|---|---|
| Adjustment Unit Group 1 | −2 | −1 | 0 | +1 | +2 |
| Adjustment Unit Group 2 | −1.9 | −0.95 | 0 | +0.95 | +1.9 |
| Adjustment Unit Group 3 | −1.8 | −0.90 | 0 | +0.90 | +1.8 |
| Adjustment Unit Group 4 | −1.7 | −0.85 | 0 | +0.85 | +1.7 |
| Adjustment Unit Group 5 | −1.6 | −0.80 | 0 | +0.80 | +1.6 |
| Adjustment Unit Group 6 | −1.5 | −0.75 | 0 | +0.75 | +1.5 |
| Adjustment Unit Group 7 | −1.4 | −0.70 | 0 | +0.70 | +1.4 |
| Adjustment Unit Group 8 | −1.3 | −0.65 | 0 | +0.65 | +1.3 |
| Adjustment Unit Group 9 | −1.2 | −0.60 | 0 | +0.60 | +1.2 |

Table 2 is a table showing an example of a plurality of fine adjustment units that are output from the aerosol generating device 800. In detail, Table 2 shows nine fine adjustment unit groups. For example, the controller 830 may select one from among pre-stored temperature profiles as shown in Table 1, according to an external temperature detected by the temperature and humidity sensor 820. Also, the controller 830 may finely adjust the selected temperature profile according to Table 2, based on external humidity detected by the temperature and humidity sensor 820. In addition, the user may adjust or select a temperature profile through the aerosol generating device 800.

Also, the aerosol generating device 800 may record smoking history for each location, temperature profile information selected at a corresponding location, and the like, thereby constituting a preset data collection (i.e., big data). Therefore, the aerosol generating device 800 may acquire the best temperature profile information applied to the aerosol generating article 850 in various situations and learn on the basis of the acquired information. As a result, when the user moves to a new area or latest weather information in the user's area cannot be acquired, the best temperature profile may be selected or a temperature profile may be adjusted, based on data stored in the aerosol generating device 800 and a sensing result from the temperature and humidity sensor 820 of the aerosol generating device 800.

Also, the aerosol generating device 800 may include a plurality of temperature sensors and check whether or not the aerosol generating device 800 is overheated according to a temperature detected by the temperature sensors.

FIG. 9 is a view illustrating another example of an aerosol generating device.

Referring to FIG. 9, an aerosol generating device 900 may further include a heater 910, a battery 920, a Protection Circuit Module (PCM) 925, a first thermistor 930, a second thermistor 940, a temperature sensor 960, and a temperature and humidity sensor 970. The aerosol generating device 900 illustrated in FIG. 9 only shows certain elements related to the present embodiment. Therefore, it will be understood by one of ordinary skill in the art related to the present embodiment that the aerosol generating device 900 may further include other elements in addition to the elements illustrated in FIG. 9.

As illustrated herein, it is assumed that the heater 910 is arranged above the battery 920, and a long portion of a PCB (Printed Circuit Board) 950 is arranged to face a front of the battery 920. However, the location relationship between the elements may be different according to embodiments.

The heater 910 illustrated in FIG. 9 may be at least one of the internal heating heaters 410, 411, and 412 and the external heating heaters 420, 421, and 422 illustrated in FIGS. 4A through 4N. Also, the PCB 950 illustrated in FIG. 9 may correspond to the controller 830 illustrated in FIG. 8.

The battery 920 may supply power to the heater 910 and may be arranged such that a top surface thereof faces a lower side of the heater 910. Although not shown in FIG. 9, the battery 920 and the heater 910 may be electrically connected to each other. The battery 920 may be connected to the heater 910 through the PCB 950 or may be directly connected to the heater 910.

The PCM 925 may be arranged adjacent to the top surface of the battery 920. The PCM 925 is a circuit for protecting the battery 925 and may prevent overcharging or overdischarging of the battery 920. Also, the PCM 925 may prevent overcurrent from flowing into the battery 920 and cut off connections when a circuit connected to the battery 920 is short-circuited.

The first thermistor 930 is a resistor of which resistance is sensitively changed due to a temperature change and may be used to sense a temperature. The first thermistor 930 may be electrically connected to the PCM 925 arranged on the top surface of the battery 920, and information measured by the first thermistor 930 may be transmitted to the PCB 950 through the PCM 925.

The first thermistor 930 may be arranged adjacent to a front or rear surface of the battery 920. For example, as illustrated in FIG. 9, the first thermistor 930 may be arranged adjacent to the rear surface of the battery 920. The first thermistor 930 may be arranged adjacent to the center of the front or rear surface of the battery 920. The center of the front or rear surface of the battery 920 corresponds to a portion having the highest temperature in the battery 920, and thus corresponds to a portion most affecting damage or explosion of the battery 920. The aerosol generating device 900 may measure a temperature of the portion most affecting the damage or explosion of the battery 920 by using the first thermistor 930, and whether or not the aerosol generating device 900 is overheated may be determined on the basis of the measured temperature.

The second thermistor 940 may be arranged between the heater 910 and the battery 920. A space between the heater 910 and the battery 920 corresponds to a portion having the highest temperature in the aerosol generating device 900, and thus corresponds to an appropriate portion for determining an overall overheating state of the aerosol generating device 900. At least a portion of the PCB 950 may extend across the space between the heater 910 and the battery 920, and the second thermistor 940 may be arranged adjacent to the at least portion of the PCB 950 extending across the space between the heater 910 and the battery 920.

The PCB 950 may determine whether or not the aerosol generating device 900 is overheated, on the basis of temperatures measured by the first thermistor 930 and the second thermistor 940. When the aerosol generating device 900 is determined as being overheated, the PCB 950 stand by until overheating is released, and then automatically perform a heating operation using the heater 910.

The temperature sensor 960 may be arranged adjacent to the heater 910 to directly or indirectly measure a temperature of the heater 910. The heater 910 is a portion most affecting a cigarette inserted into the aerosol generating device 900, and characteristics of the aerosol generated from the cigarette may be changed according to the temperature of the heater 910. The aerosol generating device 900 according to the present embodiment may determine whether or not the aerosol generating device 900 is overheated, on the basis of the temperature of the heater 910 measured by the temperature sensor 960. Therefore, if hardware components inside the aerosol generating device 900 is not expected to be damaged by additional heating operation but the additional heating operation is expected to adversely affect the characteristics of the aerosol generated from the cigarette, the aerosol generating device 900 may be determined as being overheated.

The temperature and humidity sensor 970 may be arranged in the vicinity of a bottom surface of the battery 920 to measure temperature or humidity. The vicinity of the bottom surface of the battery 920 is a portion that is least affected by the heater 910, and thus may have a similar temperature to an external housing constituting an exterior of the aerosol generating device 900. The aerosol generating device 900 according to an embodiment may determine whether or not the aerosol generating device 900 is overheated, on the basis of a temperature of the vicinity of the bottom surface of the battery 920 measured by the temperature and humidity sensor 970. Therefore, the aerosol generating device 900 may determine, as an overheating state, a state in which external temperature is excessively high.

The PCB 950 may determine whether or not the aerosol generating device 900 is overheated, on the basis of temperatures measured by at least two of the first thermistor 930, the second thermistor 940, the temperature sensor 960, and the temperature and humidity sensor 970. As described above, the aerosol generating device 900 according to an embodiment may determine an overheating state thereof by comprehensively considering possibility of damage to hardware components inside the aerosol generating device 900, the characteristics of the aerosol generated from the cigarette, possibility of occurrence of safety issues due to the external temperature, and the like. Therefore, the aerosol generating device 900 may be maintained in the best state.

The aerosol generating device 900 may be connected to an external device through a wireless communication method and may be controlled through an application installed in the external device.

FIG. 10 is a block diagram illustrating an example in which an aerosol generating device is connected to an external device.

An aerosol generating device 1010 of FIG. 10 may be the aerosol generating device 810, 820, or 900 described above with reference to FIGS. 8 through 9.

An external device 1020 may be a smartphone, a tablet PC, a PC, a smart TV, a mobile phone, a personal digital assistant (PDA), a laptop, a media player, a micro server, a global positioning system (GPS) device, an e-book terminal, a digital broadcasting terminal, a navigation system, kiosk, an MP3 player, a digital camera, home appliances, and other mobile or non-mobile computing devices but is not limited thereto. Also, the external device 1020 may be a wearable device such as a watch, glasses, a hairband, and a ring having a communication function and a data processing function. However, the external device 1020 is not limited thereto and may include all types of devices capable of communicating with the aerosol generating device 1010.

The aerosol generating device 1010 and the external device 1020 may be communicatively connected.

As an example, the aerosol generating device 1010 and the external device 1020 may be communicatively connected through a network. In this case, the network may include local area network (LAN), wide area network (WAN), value added network (VAN), a mobile radio communication network, a satellite communication network, and a combination thereof. Also, the network may refer to a comprehensive data communication network that allows the aerosol generating device 1010 and the external device 1020 to smoothly communicate with each other, and may include the wireless Internet and a mobile wireless communication network.

For example, wireless communication may include Wi-Fi, Bluetooth, Bluetooth low energy, Zigbee, Wi-Fi Direct (WFD), ultra-wideband (UWB), infrared Data Association (IrDA), near field communication (NFC), and the like but is not limited thereto.

As another example, the aerosol generating device 1010 and the external device 1020 may be communicatively connected by wire. Wire communication may include, for example, universal serial bus (USB), high definition multimedia interface (HDMI), recommended standard 232 (RS-232), plain old telephone service (POTS), or the like.

When the aerosol generating device 1010 and the external device 1020 are connected, a user may control the aerosol generating device 1010 through an application 1030 installed in the external device 1020. For example, through the application 1030, the user may turn on off power of the aerosol generating device 1010 and determine a temperature profile of a heater. Also, the user may update software of the aerosol generating device 1010 through the application 1030.

The user may check information about the aerosol generating device 1010 through the application 1030. For example, the user may check, through the application 1030, states of elements (e.g., a battery, the heater, and the like) included in the aerosol generating device 1010. Also, the user may check, through the application 1030, environment information (e.g., temperature, humidity, the level of fine dust, and the like) about an area where the aerosol generating device 1010 is located. Also, the user may check information about a nearby service center through the application 1030.

At least one of the components, elements, modules or units (collectively "components" in this paragraph) represented by a block in the drawings such as the controller in FIGS. 6 and 8 may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

Those of ordinary skill in the art related to the present embodiments may understand that various changes in form and details may be made therein without departing from the scope of the characteristics described above. The disclosed methods should be considered in a descriptive sense only and not for purposes of limitation. The scope of the present disclosure is defined in the following claims rather than in the foregoing description, and all differences within the equivalent range should be construed as being included in the present disclosure.

The invention claimed is:

1. An aerosol generating article comprising:

an aerosol generator comprising a first aerosol generating material which does not include nicotine;

a tobacco filler arranged adjacent to an end of the aerosol generator and comprising a second aerosol generating material including nicotine;

a cooler arranged adjacent to an end of the tobacco filler and configured to cool aerosol; and a mouthpiece arranged adjacent to an end of the cooler, wherein the aerosol generator comprises a sheet formed of a polymer material, and the first aerosol generating material is impregnated into the sheet.

2. The aerosol generating article of claim 1, wherein the polymer material comprises at least one from among paper, cellulose acetate, lyocell, and polylactic acid.

3. The aerosol generating article of claim 1, wherein the mouthpiece comprises at least one capsule comprising a flavored liquid or an aerosol generating material.

4. The aerosol generating article of claim 1, further comprising a heat conductive wrapper surrounding, entirely or partially, the aerosol generator and the tobacco filler, wherein the heat conductive wrapper is formed of a paramagnetic material.

5. The aerosol generating article of claim 1, wherein the cooler is formed of paper and comprises a tube-type structure having a hollow inside.

6. The aerosol generating article of claim 5, wherein an inner surface of the cooler is coated with polylactic acid.

7. An aerosol generating device comprising:

a heater configured to heat an aerosol generating article;

a first sensor configured to detect whether the aerosol generating article is inserted into the aerosol generating device; and a controller configured to control an operation of the heater based on a sensing result from the first sensor.

8. The aerosol generating device of claim 7, further comprising a second sensor configured to detect at least one from among a temperature and humidity at a location of the aerosol generating device, wherein the controller selects one temperature profile from among pre-stored temperature profiles based on a detection result from the second sensor.

9. The aerosol generating device of claim 8, wherein the controller selects the one temperature profile from among the pre-stored temperature profiles based on the temperature, and adjusts the selected temperature profile based on the humidity.

10. The aerosol generating device of claim 8, further comprising:

a third sensor configured to detect a temperature of the heater;

a fourth sensor configured to detect a temperature of a battery; and a fifth sensor detecting a temperature of a space between the heater and the battery, wherein the controller determines whether the aerosol generating device is overheated based on detection results from a plurality of sensors selected from among the second through fifth sensors.

11. An aerosol generating system comprising:

an aerosol generating device comprising a space into which an aerosol generating article is inserted, and configured to heat the inserted aerosol generating article; and an external device configured to control at least one function of the aerosol generating device by an application installed in the external device, through a wireless communication network.

12. The aerosol generating system of claim 11, wherein the aerosol generating device is turned on/off by a control signal of the application.

13. The aerosol generating system of claim 11, wherein a temperature profile related to heating of a heater included in the aerosol generating device is determined by a control signal of the application.

14. The aerosol generating system of claim 11, wherein software related to operation of the aerosol generating device is updated by a control signal of the application.

* * * * *